United States Patent [19]

Schulze

[11] Patent Number: 4,958,548

[45] Date of Patent: Sep. 25, 1990

[54] HYDRAULIC DRIVE MECHANISM

[76] Inventor: Eckehart Schulze, Stahlbühlstr. 36, 7251 Weissach 2, Fed. Rep. of Germany

[21] Appl. No.: 368,318

[22] PCT Filed: Oct. 15, 1988

[86] PCT No.: PCT/DE88/00635

§ 371 Date: Jun. 16, 1989

§ 102(e) Date: Jun. 16, 1989

[87] PCT Pub. No.: WO89/03484

PCT Pub. Date: Apr. 20, 1989

[30] Foreign Application Priority Data

Oct. 16, 1987 [DE] Fed. Rep. of Germany ..... 3735123

[51] Int. Cl.[5] ..... F15B 11/08

[52] U.S. Cl. ..... 91/420; 91/433; 91/415; 91/392

[58] Field of Search ..... 91/392, 398, 404, 420, 91/433, 417, 235, 415, 321, 465

[56] References Cited

U.S. PATENT DOCUMENTS

| | | | |
|---|---|---|---|
| 4,205,591 | 3/1980 | Mickelson | 91/420 |
| 4,256,017 | 3/1981 | Eastman | 91/417 R |
| 4,445,421 | 5/1984 | Walker et al. | 91/433 |
| 4,461,449 | 7/1984 | Turner | 91/420 |
| 4,597,557 | 1/1986 | Krieger et al. | 91/420 |
| 4,716,812 | 1/1988 | Koerner et al. | 91/417 R |
| 4,727,797 | 3/1988 | Haussler | 91/420 |
| 4,765,227 | 8/1988 | Balazs et al. | 91/417 R |
| 4,771,674 | 9/1988 | Hugdahl | 91/433 |

FOREIGN PATENT DOCUMENTS

| | | | |
|---|---|---|---|
| 2119594 | 11/1972 | Fed. Rep. of Germany . | |
| 224443 | 3/1974 | Fed. Rep. of Germany . | |
| 2314590 | 9/1974 | Fed. Rep. of Germany | 91/420 |
| 2424973 | 12/1975 | Fed. Rep. of Germany | 91/420 |
| 2021857 | 12/1977 | Fed. Rep. of Germany | 91/420 |

*Primary Examiner*—Edward K. Look
*Assistant Examiner*—Thomas E. Denion
*Attorney, Agent, or Firm*—Antonelli, Terry, Stout & Kraus

[57] ABSTRACT

A hydraulic drive mechanism for a punching or an embossing tool, with a double-acting drive hydrocylinder with differently large piston areas, the rapid feed operation, the working feed operation, as well as the rapid retraction operation being controllable by the joint or alternative pressurization of these piston areas. For effecting switchover, an area switching valve is provided which switches over, once the driving pressure exceeds, for example, 90% of the maximum initial pressure of the pressure supply unit, from differential operation to unilateral pressurization of the larger drive area. The area switching valve comprises a check valve acted upon, in the opening direction, by the operating pressure in the smaller driving pressure chamber. A locking spring force of the check valve is equivalent to an opening pressure of about 90% of the supply pressure. The area switching valve comprises a pressure-regulated slide valve having a valve body constructed as a stepped piston urged against the check valve body by a return spring. With the check valve being closed, the smaller drive pressure chamber is pressurized. With the check valve being opened, the smaller drive pressure chamber is pressure-relieved, and the larger piston step of the stepped piston is under the pressure ambient in the larger drive pressure chamber. The ratio of the area of the larger piston step to the cross-sectional area defined by the valve seat of the check valve is larger than the ratio of the larger piston area to the smaller piston area of the hydro-cylinder.

8 Claims, 2 Drawing Sheets

HYDRAULIC DRIVE MECHANISM

BACKGROUND OF THE INVENTION

The invention relates to a hydraulic drive mechanism for a machine element such as, for example, a punching or embossing tool executing, during a course of a machining cycle of a workpiece, a rapid feed movement toward the workpiece, thereupon with the same travel direction the working stroke, and subsequently thereto a rapid retraction movement leading back into the starting position.

A number of drive mechanisms of the aforementioned type have been proposed; however, problems are encountered in such drive mechanisms in the load-responsive switchover of the differential hydrocylinder, provided as the drive element, from rapid feed operation, wherein a large as well as small working areas of the drive piston are pressurized but wherein the maximally attainable feeding power is reduced by the ratio of the small to the large piston area, into the under-load feed operation wherein only the larger piston area is acted upon by the initial pressure of the pressure supply unit but the small piston area is pressure-relieved, which is necessary if the feeding power deployable in rapid feed operation is insufficient, for example, for penetrating the workpiece in a punching operation. When choosing a distance-dependent control of the transition from rapid feed operation to under-load feed operation, the disadvantage arises that in cases where the feeding power deployable in rapid feed operation would be adequate, and thus operation could be continued in rapid feed mode, too long cycle times must be tolerated. In order to be able to obtain a time saving in this respect, the choice is thus frequently to switch over from rapid feed operation to under-load feed operation in dependence upon the operating pressure. In other words, once the pressure in the drive pressure chambers of the differential cylinder has exceeded a threshold value, switchover is effected by an area switching valve that is pressure-controlled from rapid feed operation to under-load feed operation. However, in such a case, care must be taken that the under-load feed operation is maintained for a sufficient period of time to ensure that the pressure-controlled valve does not switch over "too early" again to rapid feed operation which could lead to undesirable vibrations and, in the extreme case, to an approximate standstill of the tool.

In order to overcome the above-mentioned problem, consideration could be given to equipping the pressure-controlled valve with an electromagnetic holding control unit in such a way that it additionally includes a control magnet maintaining the valve as soon as the latter has been switched over in dependence upon the pressure from rapid feed operation to under-load feed operation for a defined period of time in the functional position providing for under-load feed operation. However, in order to be able to utilize optimally short cycle periods, this procedure would have the consequence that the delay time during which the valve, to be switched in dependence upon the pressure, is maintained in its under-load operation function mode would have to be adapted in each case to the material thickness of the material to be worked upon. This would not only entail a considerable time consumption but also, in many cases, would result in erroneous settings which, in turn, would lead to unnecessarily long cycle times.

Therefore, it is an object of the present invention to improve a hydraulic drive mechanism of the type discussed hereinabove so that a need-responsive switchover of the drive mechanism from rapid feed operation to under-load feed operation and from the latter again to rapid feed operation and, respectively, final rapid retraction operation is made possible, independently of the thickness of a workpiece to be machined.

In accordance with advantageous features of the present invention, the hydraulic drive mechanism for a machine element such as, for example, a punching tool or an embossing tool, executing, during a course of a machining cycle of a workpiece, a rapid feed movement leading to the workpiece, thereupon, with a same travel direction, a working stroke and subsequently a rapid retraction stroke leading back into an initial position. The hydraulic drive mechanism includes a double-acting hydrocylinder as the drive element, with the double-acting hydrocylinder being constructed as a differential cylinder reciprocably accommodating a piston having a small and a large piston area defining a large and small pressure chamber. The hydraulic cylinder is adapted to provide a rapid feed operation by jointly applying an initial pressure of a pressure supply unit, and alternative pressurization and pressure relief while making it possible to control an under-load and working feed of the machine element at an increased feeding power as well as a rapid retraction operation. A pressure-controlled area switching valve is provided for switching from rapid to under-load feed operation, with the switching valve, once the drive pressure and the drive pressure chambers of the hydrocylinder exceeds a threshold value corresponding to a high percentage of, for example, 90% of a maximum output pressure of the pressure supply unit, effects switchover of the hydrocylinder mains from a differential operation to a unilateral pressure application to the large drive area of the hydrocylinder and pressure relief of the small drive area. The switching valve includes a check valve which is acted upon in an opening direction by operating pressure ambient in the small drive pressure chamber of the hydrocylinder movably defined by the small piston area of the differential piston. A closing force of a pretension closing spring urges a valve body of the check valve into a closed position by a closing force equivalent to an opening pressure of 85%–95% of the initial pressure of the pressure supply unit.

Advantageously, in accordance with further features of the present invention, the switching valve further includes a pressure-control slide valve with a valve body constructed as a stepped piston having a large and small piston step. The valve body is urged by a slightly pretension return spring into contact with the valve body of the check valve and, in a closed position of the check valve, is retained in a functional position wherein the small dry pressure chamber of the hydrocylinder is exposed to the output pressure of the pressure supply unit and, in an open position of the check valve, enters into a position wherein the small drive pressure chamber is pressure relieved. The large piston step of the piston is acted upon, on its larger piston step, by pressure ambient in the large drive pressure chamber of the hydrocylinder.

Advantageously, a ration $F_5/F_4$ of an effective area $F_5$ of the large piston step of the stepped piston to a cross-sectional area $F_4$ bounded by a valve seat of the check valve, within which the valve body is acted upon in the opening direction by the pressure ambient in the small drive pressure chamber, is larger by a defined fraction A of 10% to 30% than the ratio $F_1/F_3$ of the large piston area $F_1$ defining the large drive pressure chamber of the hydrocylinder to the small piston area $F_3$ defining the small drive pressure chamber.

A substantial advantage over conventional drive mechanisms is obtained with viewpoints of saving time, and due to the simplicity of the total structure also a high functional reliability is achieved, due to the accordingly provided configuration of the area switching valve in the form of a valve controlled exclusively in dependence upon the pressure wherein, by the closing force of a check valve with an adjustable force whereby the response pressure can be adjusted in a defined fashion, in combination with a multiple-way valve which produces a "hysteresis" required to prevent the drive mechanism from switching "too early" back to rapid feed operation.

According to the present invention of the switching valve includes a spherical valve member, with the spherical valve member being urged against the valve seat of the check valve by a closing spring with an adjustable bias.

In order to provide a simple structure of a directional control valve, in accordance with still further features of the present invention, a solenoid valve, fashioned as a 3/3-way valve, is provided for the directional control of the feeding and retraction motions of the piston of the drive hydrocylinder. The solenoid valve is controllable by alternative energization of control magnets into alternative functional positions wherein, in one functional position, a high pressure outlet of the pressure supply unit is connected to the large drive pressure chamber of the hydrocylinder, and in another functional position, the drive pressure chamber is pressure-relieved whereas the small drive pressure chamber can be exposed through the pressure control multiple-wave valve of the switching valve to the initial pressure of the pressure supply unit and/or relieved toward a non-pressurized tank of the pressure supply unit.

Additional objects, features, and advantages of the present invention will become more apparent from the following description of a specific embodiment when taken in connection with the accompanying drawings.

DETAILED DESCRIPTION

Figure 1:
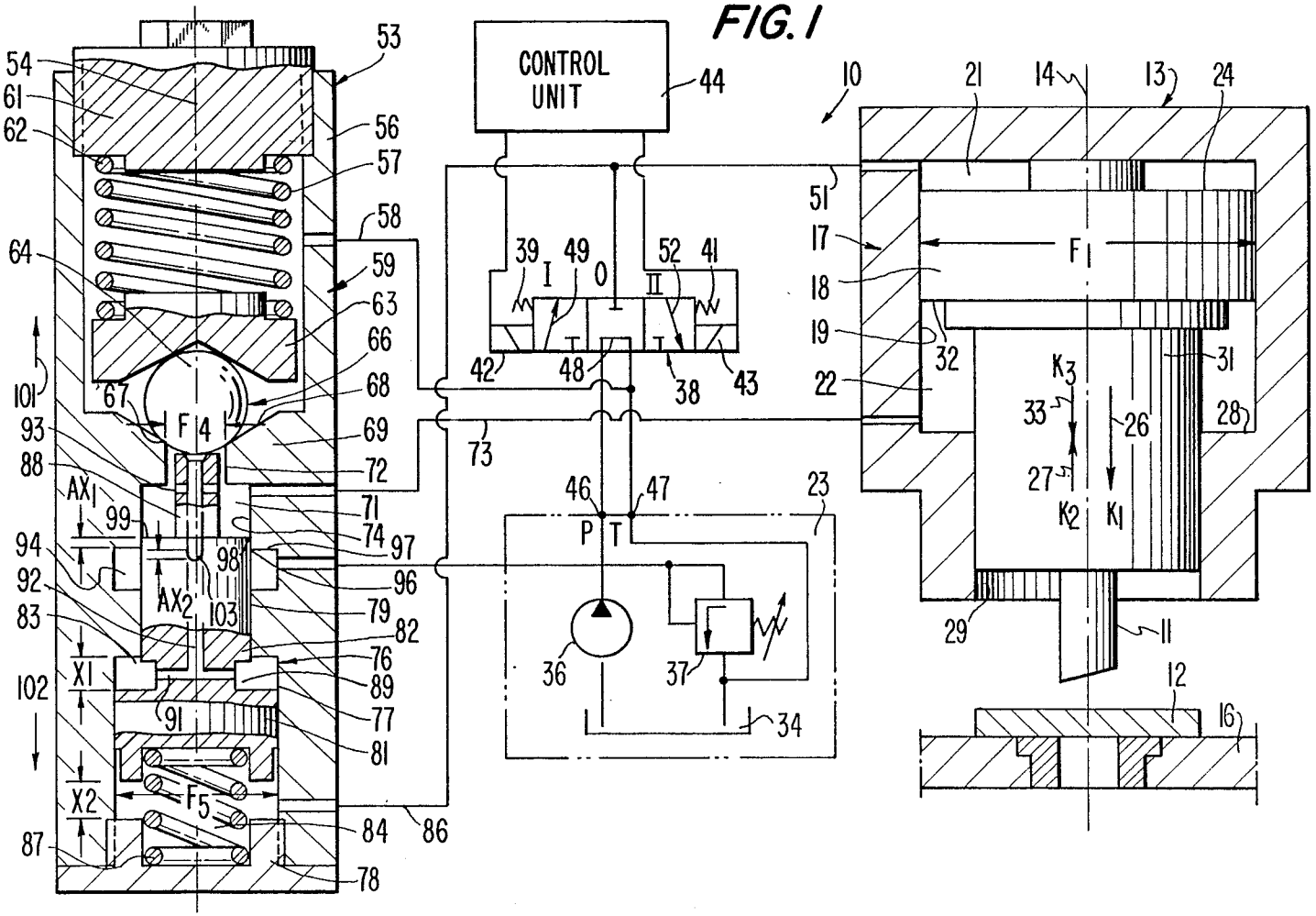
FIG. 1 is a partly schematic longitudinal cross-sectional view of a hydraulic drive mechanism according to the present invention including a drive element and a switching valve.

Referring now to the drawings wherein like reference numerals are used throughout the various views to designate like parts and, more particularly, to FIG. 1, according to this figure, a hydraulic drive mechanism generally designated by the reference numeral 10 forms a drive block 4, for example, a punching or embossing machine, with the hydraulic drive mechanism including a hydrocylinder generally designated by the reference numeral 13 acting as a drive element for a tool 11 by which a workpiece 12 such as, for example, a steel plate, can be subjected to penetrating or embossing cold forming. In the illustrated embodiment, the hydrocylinder 13, is constructed as a double-acting linear hydraulic cylinder.

In the illustrated embodiment, the hydrocylinder 13 is presumed to be arranged in an upright position, that is, with a vertical extension of a central longitudinal axis 14 thereof being substantially perpendicular to a horizontally disposed machine table 16 forming a portion of a machine frame. A housing 17 of the hydrocylinder 13, mounted to the machine table 16, is fixedly attached to the machine frame.

A workpiece 12, resting on the machine table 16, can be fixed in position on the machine table by a holding fixture (not shown).

The hydrocylinder 13 is constructed as a differential cylinder-piston arrangement, with a piston generally designated by the reference numeral 18 of the differential cylinder-piston arrangement being reciprocatable within a cylinder bore 19 so as to define two drive pressure chambers 21 and 22. By applying a valve controlled initial pressure P of a pressure supply unit generally designated by the reference numeral 23 are alternatively to the pressure chambers 21, 22, and by an optional pressure relief respectively applied to one of the two drive pressure chambers 21 or 22, the advancing and retracting strokes of the piston 18 and, respectively, of the tool 11 required for the machining of the workpiece 12 can be controlled as needed.

The workpiece 12, resting on the machine table 16, can be fixed in position on the machine table 16 by means of a holding fixture, not individually illustrated.

The hydrocylinder 13 is designed as a differential cylinder; the piston of the latter, denoted in total by 18 and being reciprocatable, defines in a pressure-tight fashion two drive pressure chambers 21 and 22 within the cylinder bore 19. By applying, controlled by a valve, the initial pressure P of a pressure supply unit denoted by 23 in its entirety jointly or alternatively to these chambers, The effective amount of the piston area 24 movably defining the drive pressure chamber 21 that is at the top drive pressure chamber in FIG. 1 is equal to a cross-sectional area $F_1$ of the cylinder bore 19.

By applying the initial pressure P of the pressure supply unit 23 to the upper drive pressure chamber 21, a force $K_1$ is thus exerted on the piston 18 acting in the direction of arrow 26, that is, in a direction i.e. oriented toward the workpiece 12, in accordance with the following equation:

$$K_1 + F_1 \cdot P \quad (1)$$

By applying the initial pressure P of the auxiliary pressure supply unit 23 to the drive pressure chamber 22 that is at the bottom of FIG. 1, a force $K_2$ is exerted on the piston 18 of the hydrocylinder 13 acting in a direction of arrow 27, that is in the opposite direction, with an amount of the force being given by the following equation:

$$K_2 = (F_1 - F_2) \cdot P = F_3 \cdot P. \quad (2)$$

In equation (2); $F_2$ means the effective cross-sectional area of the housing bore 29, offset by an internal housing step 28 with respect to the cylinder bore 19 wherein the cylinder piston 18 is displaceably guided in a pressure-tight fashion. The cylindrical piston rod 31 is displaceably guided in a pressure-tight fashion in the housing bore 29 and is fixedly joined to the piston 18, for example by being integrally constructed with the piston 18, the tool 11 being attached to the lower, free end of the piston rod 31.

$F_3$ equals the effective amount of the "differential area" 32 having essentially the shape of a circular ring, acted upon by a pressure coupled into the lower drive pressure chamber 22 and effective on the cylinder piston 18 along the lines of producing the force $K_2$.

It is presumed for the illustrated embodiment for explanatory purposes that the area ratio $F_1/F_3$ has a value of 2/1.

If the initial pressure P of the auxiliary pressure supply unit 23 acts on both drive pressure chambers 21 and 22, then the force $K_3$ maximally usable for the adjustment and working advance of the tool 11, acting in the direction of the arrow 33 in parallel to arrow 26, is determined by the following equation:

$$K_3=K_1-K_2 \quad (3)$$

The maximum amount of the feeding force $K_3$ is restricted — in case of the 2/1 of the area ratio — to 50% of the feeding force $K_1$ maximally attainable, which force can be achieved in the case wherein only the upper drive pressure chamber 21 is acted upon by the initial pressure P of the pressure supply unit 23 whereas the lower drive pressure chamber 22 is relieved in the direction toward a non-pressurized tank 34 of the pressure supply unit 23.

In order to place the piston 18 in basic position illustrated in FIG. 1, in each instance assumed at the beginning of a working cycle, the lower drive pressure chamber 22 is exposed to the initial pressure of the pressure supply unit 23, and the upper drive pressure chamber 21 is relieved toward the non-pressurized tank 34 of the pressure supply unit 23. The pressure supply 23 unit, in the construction of FIG. 1 as is customary, includes a high-pressure pump 36 and a pressure relief valve 37 adjustable to a desired initial pressure range.

An electrically actuatable directional control valve 38, fashioned as a 3/3-way solenoid valve, is provided for regulating the alternative directions of movement of the piston 18 and, respectively, of the tool 11, namely the advancing and/or rapid feed and working and, respectively, under-load feed movements, on the one hand, and the retraction movement up into the basic position, on the other hand. The control valve 38 exhibits, as the basic position 0, a neutral middle position "centered" by return springs 39 and 41 wherein the pressure supply unit 23 operates in circulating mode.

By an alternative excitation of one of two control magnets 42 and 43, respectively, the directional control valve 38 can be regulated to assume, in each case from a basic position, alternative functional positions I and II, respectively, with the functional position I being associated with the feeding direction of the piston movement and the functional position II being associated with the retraction direction of the piston or tool movement. The activating signals for the control magnets 42 and 43, required for movement control, of the directional control valve 38 are produced by a driver stage 44 which, in turn, can be controlled manually, for example by manual keys (not shown) or also automatically in correspondence with the required motion process, in an electronic fashion.

In the embodiment illustrated, the directional control valve 38 is designed as a 3/3-way valve by way of which control can be exerted merely over the large upper connection of the drive pressure chamber 21, either to the high-pressure outlet 46 of the pressure supply unit 23 or to the tank connection 47 of the pressure supply unit 23.

In the basic position 0 of the directional control valve 38, the upper drive pressure chamber 21 of the hydrocylinder 13 is blocked against the high-pressure outlet 46 as well as against the tank connection 47 of the pressure supply unit 23 whereas the high-pressure outlet 46 and the tank connection 47 of the pressure supply unit 23 are in communication with each other through a circulation flow path 48 of the directional control valve 38.

In the activated position I of the directional control valve 38, assumed upon energization of one of the control magnets 42 by an output signal of the driver stage 44, the high-pressure outlet 46 of the pressure supply unit 23 is connected through a first passage flow path 49 of the directional control valve 38 with the supply connection 51 of the upper — larger — drive pressure chamber 21 of the hydrocylinder 13, but the pressure chamber 21 is blocked with respect to the tank connection 47.

In the functional position II of the directional control valve 38 alternative thereto, assumed upon energization of the second control magnet 43 by an output signal of the driver stage 44, the upper drive pressure chamber 21 of the hydrocylinder 13 is connected through a second passage flow path 52 of the directional control valve 38 with the tank connection 47 of the pressure supply unit 23, but is blocked with respect to the high-pressure outlet 46.

An area switching valve generally designated by the reference numeral denoted in its 53 having a longitudinal center axis 54 and housing 56, is provided for regulating the additionally needed pressure application and relief of the annular drive pressure chamber 22 of the hydrocylinder 13 whereby as a result the velocity and the maximum amount of force used by the tool 11 to execute its feeding and working movements can be controlled.

Figure 3:
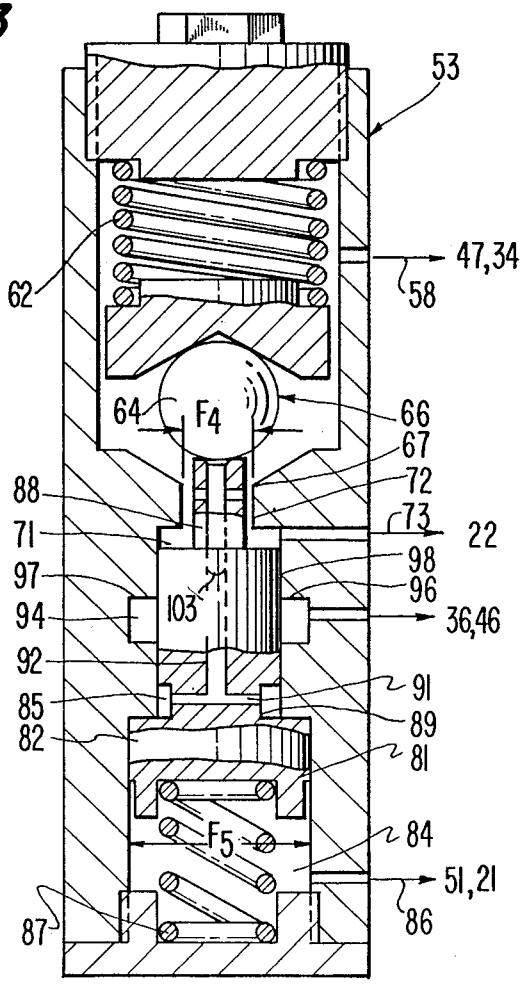
FIG. 3 is a longitudinal cross-sectional view of the switching valve of FIG. 1 in a second operation position.
Figure 2:
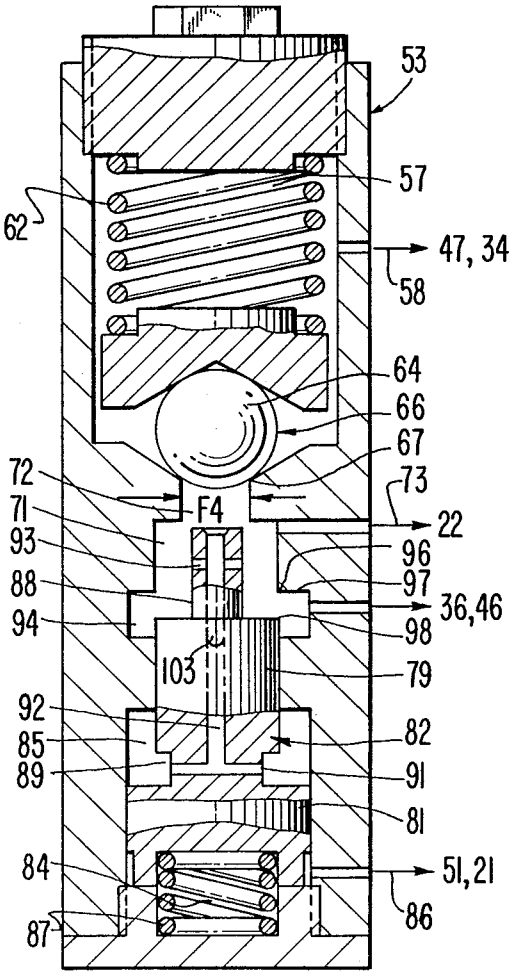
FIG. 2 is a longitudinal cross-sectional view of the switching valve of FIG. 1 in a first operating position.

As shown in FIGS. 2 and 3, the area switching valve 53, in its basic position (FIG. 1) corresponding to the non-activated condition of the drive mechanism 10, is with regard to its function a pressure-controlled multiple-way valve which automatically, as needed, establishes connection of the annular-volume drive pressure chamber 22 of the hydrocylinder 13 with the high-pressure outlet 46 of the pressure supply unit 23 in dependence upon the pressures ambient in the drive pressure chambers 21 and 22 of the drive hydrocylinder 13. In this case, the feeding power maximally exploitable for machining of the work-piece 12 is determined by equation (3) but in return a relatively high feeding velocity can be utilized. Alternatively, the switching valve 53 provides pressure relief of the drive pressure chamber 22 toward the non-pressurized tank 34 of the pressure supply unit 23 if an increased feeding force is required for treatment of the workpiece 12. The maximum amount of this force is determined by equation (1), but here the feeding speed that is then still usable is reduced by the factor $F_3/F_1$. On the other hand, the area switching valve 53 fulfills the function that, after having been switched into its functional position affording pressure relief of the annular-volume drive pressure chamber 22 and thereby providing utilization of an increased feeding force, the switching valve 53 is switched back into its functional position wherein the switching valve 53 again effects pressurization of the annular drive pressure chamber 22 only after the need for feeding power at the tool 11, required for example — for a penetrating — treatment of the workpiece 12, has become lower by a defined minimum amount ΔK than the amount of feeding force and/or operating pressure in the drive pressure chambers 21 and 22 of the hydrocylinder 13 which, when exceeded, triggered the switching over of the area switching valve 53 into its functional position affording pressure relief of the annular drive pressure chamber 22.

Thereby, the objective is attained that, as long as possible, a maximally high feeding velocity of the tool 11 can be exploited and it is ensured that, after the drive mechanism 10 has been switched over to increased feeding force, "switch-back" to a reduced feeding force is not effected "too early" which could lead to undesirable vibrations and, consequence, to a "standstill" of the tool 11.

The area switching valve 53 comprises a first valve chamber 57 permanently connected through a relief flow path 58 with the tank connection 47 of the pressure supply unit 23 and is thereby maintained in a non-pressurized condition.

The valve chamber 57 is sealed tightly toward an outside by a set screw 61 constituting one end wall of a valve housing generally designated by the reference numerable 59. By rotating the setscrew 61, a bias of a valve locking spring 62 can be set, with the valve locking spring 62 engaging a centering member 63 and urging a valve body 64, constructed as a sphere of a check valve generally designated by the reference number 66, against a valve seat 67 of the check valve 66, i.e., into a closing position of the check valve 66. The valve seat 67 is constituted by a rim, reduced by the inner, i.e., inside diameter of a conical depression 68 of an intermediate wall 69 of the valve housing 59. The depression 68, in turn, serves for centering the valve body 64.

A valve duct 72 extends between the valve seat 67 and a central valve chamber 71 and terminates in the central valve chamber 71. The central valve chamber 71 is in constant communication, through a first hydraulic control conduit 73, with an annular volume drive pressure chamber 22 of the hydrocylinder 13. The central valve chamber 71 is fixedly defined in the housing 59 by one bore step 74, smaller in diameter, of a stepped bore generally designated by the reference number 76 (FIG. 1). of the housing. The bore step 77, larger in diameter, is pressure-tightly sealed off at the other end of housing 59 by a housing lid 78 constituting the end wall of the valve housing 59 at that location.

In the two bore steps 74 and 77 of the stepped bore 76, a stepped piston generally designated by the reference numeral 82 is displaceably guided in pressure-tight fashion with respect to the piston step 79 and 81, respectively, of corresponding diameter. The smaller piston step 79 of this piston forms an axially movable limitation of the central valve chamber 71, and the piston step 81 of larger diameter of the step piston 82 forms the axially movable boundary of an annular chamber 85 defined in the axial direction fixedly within the housing by the annular housing step 83 forming the intermediary between the smaller bore step 74 and the larger bore step 77, and forms the axially movable boundary of a control chamber 84, with the axial boundary of the latter, fixed with respect to the housing, being constituted by the housing cover 78. This control chamber 84 is kept, through a second hydraulic control line 86, in constant communication with the large drive pressure chamber 21 of the drive hydrocylinder 13.

The stepped piston 82 is urged in the direction of the valve sphere 64 by a — slightly pretensioned — return spring 87 supported on the inside of the housing cover 78. In the basic position in FIG. 1, the stepped piston 82 rests with a plunger-like, axial extension of its smaller piston step 79 against the valve sphere of the check valve 64. The outer diameter of the plunger-like extension 88 is markedly smaller than the diameter of the valve duct 72 through which it passes. The smaller piston step 79 is offset with respect to the larger piston step 81 by a constriction 89 formed as an annular groove and penetrated by a transverse bore 91 terminating in the annular chamber 85. This transverse bore 91 is in constant communication with the central valve chamber 71 through a central longitudinal bore 92 passing through the smaller piston step 79 and its plunger-like extension 88 in the axial direction and via one or several cross bores 93 of the plunger-like extension 88.

The smaller bore step 74 is, as viewed in an axial direction, provided in its central zone with a radial widened portion 94 having the shape of an annular groove. The wider portion 94 is connected by way of a third control conduit and, respectively, pressure supply conduit 95 permanently with the high-pressure outlet 46 of the pressure supply unit 23. The edge formed by the radially inner rim 96 of the groove flank 97 facing the central valve chamber 71 and located at the top in FIG. 1 constitutes a control edge integral with the housing, and the outer rim 98 of the annular end face 99 of the smaller piston step 79, defining the central valve chamber 71 can cooperate, as a movable control edge, with this first-mentioned control edge.

In the illustrated basic position of the stepped piston, the movable control edge 98 of the stepped piston 82 is located in positive overlapping position with the control edge 96 integral with the housing, this overlapping $\Delta X_1$ corresponding only to a small fraction of the stroke $\Delta X_1$ that can be executed by the stepped piston 82 from its illustrated basic position in the opening direction of the seat valve 66, i.e. in the direction of arrow 101, and also corresponding to only a small fraction of the stroke $X_2$ that can be executed by the stepped piston 82 in the opposite direction, i.e. in the direction of arrow 102. In the illustrated basic position of the stepped piston 82, the annular chamber defined by the annular-groove-shaped flaring portion 94 and the smaller piston step 79 is not hermetically sealed with respect to the central valve chamber 71, the overlapping $\Delta X_1$ of the movable control edge 98 and the housing-integral control edge 96 notwithstanding; rather, this annular chamber is still in communicating connection with the central valve chamber by a peripheral marginal notch 103 with a small overflow cross section. However, this connection is eliminated once the stepped piston 82 has executed a small fraction $\Delta X_2$ of its possible stroke in the direction of arrow 101 whereafter the flaring portion 94 of annular groove shape, pertaining to the smaller bore step 74 and in communication with the high-pressure outlet 46 of the pressure supply unit 23 is blocked off against the central valve chamber 71.

The bias of the valve closing spring 62 is, or will be, adjusted to such a level that the force with which the valve sphere of the check valve 64 is urged against the circular-line-shaped valve seat 67 corresponds approximately to that force, e.g. corresponds to 90% of that force, exerted by the maximum outlet pressure of the pressure supply unit 23 on the valve sphere of the check valve 64 within the circular area bounded by the valve seat 67. Presuming a maximum outlet pressure of the pressure supply unit 23 of 300 bar, the bias of the closing spring 62 is accordingly set to a value equivalent to a "closing pressure" of 270 bar.

In contrast thereto, the bias of the return spring 87 is negligible and is equivalent to a pressure of, for example, e.g. 5 bar. Designating the circular area bounded by the valve seat 67, within which the initial pressure P of the pressure supply unit 23 can be effective on the valve sphere of the check valve 64, by $F_4$ with respect to its amount, and designating the cross-sectional area of the larger piston step 81 of stepped piston 82, likewise exposable to the initial pressure P of the pressure supply unit 23, by $F_5$, then these cross-sectional areas at the area switching valve 53 are dimensioned so that they satisfy the following equation:

$$F_5/F_4 = F_1/F_3 + A, \quad (4)$$

wherein A equals a predeterminable fraction of the area ratio of 20% on the order of magnitude by which the area ratio $F_5/F_4$ is to be larger in all cases than the area ratio $F_1/F_3$ of the pressure-exposable areas of the piston 18 of hydrocylinder 13.

The drive mechanism 10 operates as follows: Upon activation of the pressure supply unit 23, the directional control valve 38 is first of all made to assume its energized position II. Thereby, the larger drive pressure chamber 21 of the hydrocylinder 13 and the control chamber 84 of the area switching valve 53 are relieved toward the non-pressurized tank 34 of the pressure supply unit 23 while simultaneously the initial pressure of the pressure supply unit 23 is applied to the annular-groove-shaped widened portion 94 of the housing 59 of the area switching valve 53, its central valve chamber 71, and its annular chamber 85, as well as, through the first control line 73, to the annular-chamber-like drive pressure chamber 22 of the hydrocylinder 13. The piston 18 of the hydrocylinder 13 thereby passes first into its top end position, the basic position shown in FIG. 1, while the stepped piston 82 of the area switching valve 53, under the action of the initial pressure of the pressure supply unit 23 on an area, in total, that corresponds to the cross-sectional area $F_5$ of its larger piston step 81, is urged into its bottom end position shown in FIG. 2, i.e. a position removed from the valve sphere of the check valve globe 64. This functional position of the area switching valve 53, in combination with the energized position II of the directional control valve 38, also corresponds to the retraction operation of the hydrocylinder 18 after the tool 11 has executed its working stroke.

In order to initiate the feeding operation of hydrocylinder piston 18 from its basic position, the directional control valve 38 is switched over by excitation of its first control magnet 42 into its functional position I. Thereby, the top drive pressure chamber 21 of the hydrocylinder 13 as well as the control chamber 84 of the area switching valve 53 are connected through the throughflow path 49 of the directional control valve 38 to the high-pressure outlet 46 of the pressure supply unit 23. The stepped piston 82 of the area switching valve 53 is at this point in time pressure-relieved since it is pressurized in a neutral mode, as it were through the central valve chamber 71 and the annular chamber 85, as well as through the control chamber 84, with the initial pressure P of the pressure supply unit 23. The weak return spring 87 is now capable of displacing the stepped piston 82 in the direction toward the valve sphere of the check valve globe 64, but the stepped piston 82 is retained dynamically, i.e., by pressure oil conducted from the high-pressure pump 36 to the annular-groove-shaped widened portion 94 of the valve housing and through the control edges 96 and 98 of the housing and/or of the stepped piston 82 in negative overlapping of these control edges 96, 98; depending upon which amount of pressure oil flows over into the annular drive pressure chamber 22 of the drive cylinder 13. The tool 11 is moved in rapid feed operation in the direction toward the workpiece 12, this feeding motion taking place with an only moderate deployment of pressure in the drive pressure chambers 21 and 22 of the hydrocylinder 13. As soon as the tool 11 has impinged upon the workpiece 12, a pressure increase occurs in the drive pressure chambers 21 and 22 which is communicated uniformly through the control lines 73 and 86 also to the central valve chamber 71, the annular chamber 85, and the control chamber 84. If the feeding power during rapid feed operation is insufficient for penetrating the workpiece 12, with the consequence that the operating pressure in the drive pressure chambers 21 and 22 rises to almost the maximum value of the initial pressure P of the pressure supply unit 23, then finally the closing force of the closing spring 62 is overcome, and the valve sphere of the check valve 64 is lifted off the valve seat 67. As a result, the central valve chamber 71 enters into communication with the pressureless valve chamber 57, and the further result, linked therewith, is that now the stepped piston 82 is exposed to the high initial pressure P of the pressure supply unit 23 only with its larger piston step 81 movably defining the control chamber 84. The stepped piston 82 is thereby shifted further along the lines of lifting the valve sphere of the check valve 64 off its valve seat 67 whereby the communicating connection of the central valve chamber 71 with the groove-like flaring portion 94, which is under the high initial pressure P of the pressure supply unit 23, previously established through the notch 103, is eliminated. Thereby, the stepped piston 82 enters the "top" end position shown in FIG. 3 wherein the annular drive pressure chamber 22 is relieved by way of the central valve chamber 71 and the valve chamber 57, which is arranged "thereabove" and without pressurization anyway, toward the non-pressurized tank 34 of the pressure supply unit 23. At this point, only the upper, larger drive pressure chamber 21 of the hydrocylinder 13 is still under the high initial pressure P of the pressure supply unit 23. The hydrocylinder now executes, in under-load feed operation, its working stroke, though with a lower feeding velocity but with correspondingly increased power. Once the workpiece 12 has been machined, e.g. penetrated, the pressure in the drive pressure chamber 21 dropping again, the corresponding pressure drop also occurs in the control chamber 84 of the area switching valve 53 so that the valve closing spring 62 is again capable of urging the stepped piston 82 back into the direction toward its basic position. However, due to the differing area ratios $F_5/F_4$ and $F_1/F_3$ provided in accordance with equation (4), the pressure value below which the annular drive pressure chamber 22 is again exposed, through the area switching valve 53, to the initial pressure of the pressure supply unit 23, is lower than the pressure at which previously switchover was performed to sole pressure application to the larger drive pressure chamber 21. The objective is thereby attained that transition from the "slow" under-load feeding operation to the completion of a working stroke in rapid feed operation of the tool 11, taking place again at a higher feeding velocity, occurs only when the need for increased feeding power is safely covered, and a vibration-free and thus gentle progression of the switching processes is likewise ensured.

I claim:

1. Hydraulic drive mechanism for a machine element executing, during a course of a machining cycle of a workpiece, a rapid feed movement leading to the workplace, thereupon, with a same travel direction, a working stroke and subsequently a rapid retraction stroke leading back into an initial position, the hydraulic drive mechanism including a double-acting hydrocylinder means constructed as a differential cylinder means reciprocably accommodating a differential piston having large and small pistons areas defining large and small drive pressure chambers, said hydrocylinder means being adapted to provide a rapid feed operation of the machine element by jointly applying an output pressure of a pressure supply unit, and alternative pressurization and a pressure relief thereby making it possible to control an under-load and working feed of the machine element at increased feeding power, as well as rapid retraction operation; a pressure-controlled area switching valve means for switching from rapid to under-load feed operation, said switching valve means, once a drive pressure in the drive pressure chambers of the hydrocylinder means exceeds a threshold value corresponding to a high percentage of a maximum output pressure of the pressure supply unit, effecting switchover of the hydrocylinder means from a differential operation to a unilateral pressure application to the large piston area of the differential piston of the hydrocylinder means and pressure relief of the small piston area of the differential piston of the hydrocylinder means, said switching valve means comprising a check valve means adapted to be acted upon in an opening direction by operating pressure ambient in the small drive pressure chamber of the hydrocylinder means, a valve body, a pretensioned closing spring means for urging the valve body into a closed position by a closing force equivalent to a fraction of an opening pressure of the output pressure of the pressure supply unit, said switching valve means further comprising a pressure-controlled slide valve with a valve body constructed as a stepped piston having a large and small piston step, a slightly pretensioned returned spring means for urging the valve body of the switching valve means into contact with the valve body of the check valve means and, in the closed position of the check valve means, is retained in a functional position wherein the small drive pressure chamber of the hydrocylinder means is exposed to the output pressure of the pressure supply unit and, in the open position of the check valve means, enters into a position wherein the small drive pressure chamber is pressure relieved, the large piston step of the stepped piston is acted upon by the pressure ambient in the large drive pressure chamber of the hydrocylinder means; and wherein a ratio of an effective area of the large piston step of the stepped piston to a cross-sectional area bounded by a valve seat of the check valve means, within which the valve body of the check valve means is acted upon in the opening direction by the pressure ambient in the small drive pressure chamber is larger by a defined fraction then a ratio of the large piston area defining the large drive pressure chamber of the hydrocylinder means to the small piston area, defining the small drive pressure chamber.

2. Drive mechanism according to claim 1, wherein the check valve means of the area switching valve means includes a spherical valve member, and adjustable closing spring means for urging the spherical valve member against the valve seat of the check valve means by means of a closing spring (62) with adjustable.

3. Drive mechanism according to one of claims 1 or 2, wherein a solenoid valve means is provided for directional control of the feeding and retraction motions of the differential piston of the drive hydrocylinder means, said solenoid valve means being controllable by alternative energization of control magnet means into alternative functional positions, wherein, in one functional position, a high-pressure outlet means of the pressure supply unit is connected to the large drive pressure chamber of the hydrocylinder means, and in another functional position, the drive pressure chamber is pressure-relieved whereas the small drive pressure chamber can be at least one of exposed through the switching valve means to the output pressure of the pressure supply unit or relieved toward a tank of the pressure supply unit.

4. A drive mechanism according to claim 1, wherein the threshold valve corresponds to about 90% of the maximum output pressure of the pressure supply unit.

5. A drive mechanism according to one of claims 1 or 4, wherein the defined fraction is 10% to 30% of the ratio of the large piston area to the small piston area.

6. A drive mechanism according to claim 5, wherein the machine element is one of a punching and embossing tool.

7. A drive mechanism according to claim 6, wherein the fraction of the opening pressure of the output pressure of the pressure supply unit is 85%–95% of the output pressure.

8. A drive mechanism according to claim 3, wherein the solenoid valve means is a 3/3-way valve means.

* * * * *